United States Patent [19]

Hase

[11] 4,039,789

[45] Aug. 2, 1977

[54] THEFT PROTECTION SENSOR SWITCH

[75] Inventor: Takeshi Hase, Osaka, Japan

[73] Assignee: Daiko Electronics Co., Ltd., Osaka, Japan

[21] Appl. No.: 611,447

[22] Filed: Sept. 8, 1975

[51] Int. Cl.[2] ..... H01H 35/14

[52] U.S. Cl. ..... 200/61.52; 200/61.45 R; 200/61.93

[58] Field of Search ..... 200/61.45 R, 61.47, 200/61.48–61.52, 276

[56] References Cited

U.S. PATENT DOCUMENTS

| | | | |
|---|---|---|---|
| 1,915,267 | 6/1933 | Bigelow | 200/61.52 |
| 2,892,049 | 6/1959 | Rubinstein | 200/61.52 X |
| 3,103,120 | 9/1963 | Tinney | 200/61.45 R X |
| 3,482,066 | 12/1969 | Zuehlke | 200/61.45 R |
| 3,539,740 | 11/1970 | Isenov et al. | 200/61.45 R |
| 3,673,362 | 6/1972 | Carlson et al. | 200/61.45 R |
| 3,686,534 | 8/1972 | Cook, Jr. | 200/61.48 UX |
| 3,729,602 | 4/1973 | Myers | 200/61.45 R X |
| 3,778,572 | 12/1973 | Matsui et al. | 200/61.52 X |
| 3,914,567 | 10/1975 | Reinnagel | 200/61.47 |

*Primary Examiner*—James R. Scott
*Attorney, Agent, or Firm*—Spensley, Horn and Lubitz

[57] ABSTRACT

A movement-sensitive switch for detecting small movements comprising electrically conductive top and bottom hollow members joined together along the peripheries thereof with insulation disposed thereinbetween forming a hollow chamber. Disposed within the hollow chamber is a balance weight having an acruous bottom section and a top section. The top section is coupled to an upper-extending pin which extends up into the hollow interior of the top member of the chamber. The balance weight and pin are disposed in the chamber and arranged and configured such that the arcuous bottom section is engaged with only the bottom member of the chamber such that when the chamber is moved, the pin is caused to engage the top member thereby electrically joining the top member and the bottom member together. When the balance weight returns to its equilibrium position, the pin is caused to decouple itself from the top member thereby again electrically isolating the top member from the bottom member.

9 Claims, 4 Drawing Figures

THEFT PROTECTION SENSOR SWITCH

BACKGROUND OF THE INVENTION

1. Field of the Invention

The present invention relates to the field of alarm activation means, and more specifically, to a movement-sensitive switch device.

2. Prior Art

It is known in the art that various movement-sensitive switches can be attached to stationary objects for the purpose of sensing the motion of the object when it is moved. However, these switches have been limited as to the attachment position and angle with respect to the object, and/or would not automatically reset themselves after the object had once been moved. Thus, once these prior art switches were activated they remained in the ON position. Other prior art switches such as, for example, an opening with a pendulum member disposed through the opening, required a specific mounting position and were limited in their sensitivity. The present invention overcomes the above-mentioned drawbacks in that it consists of an activation means contained within a hollow chamber. The hollow chamber can be attached in a plurality of positions to the desired object and automatically resets itself each time the object is moved.

BRIEF SUMMARY OF THE INVENTION

This invention is concerned with a switch that is intended to be fastened to a precious object such as a painting of object d'art, or to a door or other closure in order to sense the movement of the object. Thus, the present invention has particular utility for crime prevention purposes. In its broadest aspects, the present invention comprises an electrically isolated conductive top and bottom hollow members coupled together forming a discrete hollow chamber. Disposed within the hollow chamber is a selective contact means for selectively contacting the top and bottom members together. The selective contact means has a pendulum configuration whereby a movement of the chamber causes the contact means to electrically couple the top and bottom members together. After the contact has been made and the object is no longer in motion, the contact means eventually returns to its stable position with the top member again electrically isolated from the bottom member due to the pendulum action.

Thus, it is an object of the present invention to permit freedom in the position and angle of attachment of this device to an object.

Another object of the present invention is to permit the device to automatically return to the OFF position once the protected object comes to rest.

Yet another object of the present invention is to produce a movement-sensitive switch which has low sensitivity with respect to vertical shaking, such as, for example, the shaking caused by a person walking nearby yet have high sensitivity with respect to horizontal motion or tilting.

The novel features which are believed to be characteristic of the invention, both as to its organization and method of operation- together with further objectives and advantages thereof, will be better understood from the following description considered in connection with the accompanying drawings in which a presently preferred embodiment of the invention is illustrated by way of example. It is to be expressly understood, however, that the drawings are for the purpose of illustration and description only and are not intended as a definition of the limits of the invention.

DETAILED DESCRIPTION OF THE INVENTION

Figure 1:
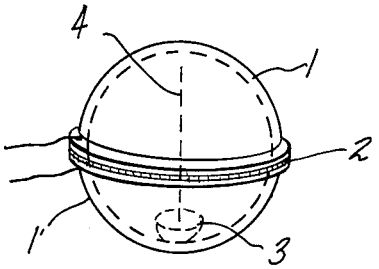
FIG. 1 is perspective view showing the hollow chamber and the contact means disposed therein indicated by hidden lines.

Referring first to FIG. 1, a novel movement-sensitive switch of the instant invention, is clearly shown. The switch comprises a top electrically conductive hollow hemispherical member 1 and an equivalently shaped bottom electrically conductive hemispherical member 1'. The top and bottom hemispherical members are joined together along the circumference thereof so as to form a hollow spherical chamber 25. Disposed along the periphery of the top and bottom members 1 and 1', is an insulation 2 so as to electrically insulate the top member 1 from bottom member 1'. In the presently preferred embodiment, members 1 and 1' each has an outward extending peripheral flange 20 and 22. Insulation 2 is then disposed between such flanges. Insulation 2 may be any of the well-known insulation material such as, for example, urethene foam, rubber, and the like. Insulation 2 is disposed between the top and bottom members 1 and 1', such that the overall configuration of the switch pin remains a hollow sphere. A contact means 11 is disposed within the sphere and comprises a balance weight 3 coupled to an upward-extending pin member 4. The balance weight 3 has a generally hemispherical bottom member 3 with a flat top section. The pin member 4 is coupled to the flat top section and extends upwardly therefrom into the hollow interior of the top member 1 a predetermined distance. Note, however, that the pin member 4, when the balance weight is in its initial stable equilibrium position, does not engage the top member 1.

While other configurations of the instant invention may be utilized, it has been found that preferable shape of the chamber to be that of a hollow sphere. Moreover, it has also been found that a preferred configuration of the balance weight 3 be that of a hemisphere although other configurations are also within the scope of this invention. Note also that the general configuration of weight 3 and pin 4 resembles a pendulum. This specific configuration is not a mere matter of choice, and enables the self-return aspects of the balance weight 3 to take place. This will be discussed in more detail herein.

Figure 2:
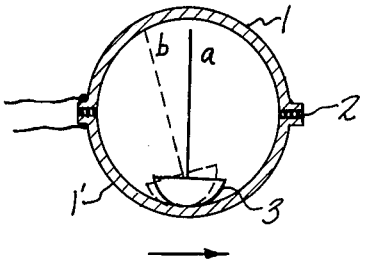
FIG. 2 is a cross-sectional view of FIG. 1 showing the contact means and indicating by phantom lines the tilting of the contact means caused by the tilting of the hollow chamber.
Figure 3:
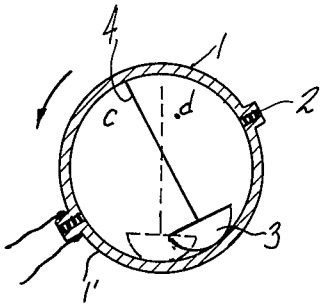
FIG. 3 is a cross-sectional view of the invention shown in FIG. 1 indicating the action of the contact means when the chamber is tilted.

When an object (not shown) to which the movement-sensitive switch of the instant invention has been attached, the pin 4 is in the *a* position as indicated in FIG. 2. In this position, there is no electrical connection between the top member 1 and the bottom member 1'. When the object is moved in the direction of the arrow shown in FIG. 2, the pin 4 assumes the *b* position due to the inertia of the balance weight 3 and pin 4. Contact is thus made with the top member 1 and a short circuit occurs between member 1 and member 1'. However, since the center of gravity of the balance weight 3 is relatively low, after a short time the pin 4 separates from top member 1 and again assumes the stable upright vertical position due to the dynamic stability of the pin 4 and balance weight 3. Again, the top and bottom members would be electrically isolated one from the other. In a case where the object is tilted, indicated by the arrow in FIG. 3, once the pin 4 assumes the *c* position, contact would be made between the top member 1 and the bottom member 1'. Again, the circuit between members 1 and 1' is achieved and the alarm device would be actuated. However, as the balance weight 3 slides over the surface of the bottom member 1', because of its unique arcuous shape, separation of pin 4 from member 1 again occurs, i.e. when the tilting stops and the weight 3 is stationary, the pin 4 returns to the *d* position due to its dynamic stability. This stability is due, in part, to the fact that the weight 3 is arranged and configured such that, when tilted, it will automatically return it to its initial position. Moreover, because weight 3 and the interior of member 1' have low friction surfaces, sliding of weight 3 toward the lowest (and most stable) point in member 1' is encouraged. Thus, by the use of the switch of the present invention, special positioning and angle of attachment of the switch of this invention need not be taken into consideration.

Figure 4:
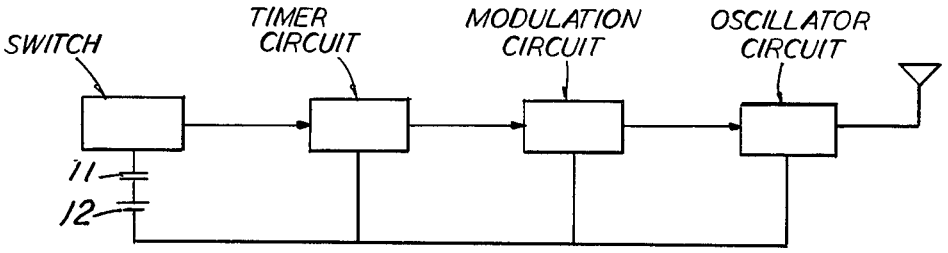
FIG. 4 is a block diagram showing typical prior art circuits which are coupled to the switch enabling the switch to broadcast an indication that the switch has been moved.

Referring now to FIG. 4, a block diagram indicating how the switch is electrically coupled to various elements in a typical alarm system is shown. In the preferred embodiment, a pulse shaping means comprising a capacitor 11 and battery 12 is electrically coupled to the switch 5. This shapes the pulse such that the timer circuit 6 may easily respond thereto. Timer circuit 6 is of well-known configuration and is designed so as to respond to short electrical pulses. Timer circuit 6 is often referred to in the art as a monostable multivibrator and is preferably included in the circuit as many times pin 4 will only momentarily contact the top member 1. Such a short contact time may not be sufficient to trigger the other circuit elements in a typical alarm circuit. Accordingly, timer circuit 6 responds to these short pulses and in turn will trigger the necessary elements of the circuit.

Thus, the purpose of timer circuit 6 is to alleviate the situation that occurs when satisfactory signals cannot be emitted due to the brevity of time interval during which the switch 5 is closed leading to intermittent opening and closing. This embodiment, therefore, enables the device of the instant invention to be built as a small transmitter that functions so as to sense motion when attached to an object.

Timer circuit 6 is electrically coupled to modulation circuit 7. Modulation circuit 7 puts a tone on the transmitted signal thereby making the signal easier to pick up by a receiver. Such a modulation circuit is also well known in the art and will not be discussed herein. Modulation circuit 7 in turn is coupled to oscillator circuit 8. Such an oscillator circuit 8 is a typical high frequency oscillator circuit as is well known in the art. Finally, oscillator circuit 8 is coupled to antenna means 9. Antenna means 9 is used to broadcast to a typical receiving means for triggering an alarm. By the use of the alarm circuit of the instant invention, only one receiver is needed and a plurality of the switches and associated circuit can be disposed at various objects and at various locations. Accordingly, tripping any one of these switches would cause the receiver to be activated.

In terms of adjusting the degree of sensitivity to suit a specific use, this is accomplished by changing the length and size of the pin, and/or the ratio of the diameter of the hollow chamber 25 to the diameter of the balance weight 3. In particular, the ratio between the diameter of the chamber 25 to the weight 3 is preferably from 3:1 to 2:1.

In terms of materials of use, there is no restriction on what materials may be used to make the electrically conductive parts, so long as such materials are electrically conductive. For example, inexpensive construction and high production volume are acheived by the use of metal plating and the like.

Moreover, even though the inner walls of the top and bottom members 1 and 1', respectively, are preferably completely hemispherical, there are no restrictions as to their external shape and if the lower surface of the bottom member 1' is made in the shape of a section of a spherical surface, it is laterally symmetrical which is really all that is necessary.

Although this invention has been disclosed and described with reference to a particular embodiment, the principles involved are susceptible of other applications which would be apparent to persons skilled in the art. Accordingly, this invention is not intended to be limited to the particular embodiment herein disclosed.

I claim:

1. A movement-sensitive switch comprising electrically conductive top and bottom hollow members joined together along the periphery thereof with insulation disposed thereinbetween, said top and bottom members joined together so as to form a hollow, dry chamber; and a conductive balance weight having an arcuous bottom secand an electrically conductive balance weight having an arcuous bottom section and an integral top section, said top section being fixed to an upwardly-extending electrically conductive pin, said balance weight and said pin disposed in said chamber and arranged and configured therein such that (i) said arcuous bottom section is engaged with only said bottom member of said chamber in a stable equilibrium position, and said pin member extends upwardly into the hollow interior of said top member of said chamber a predetermined distance; and (ii) when said chamber is moved, said pin is caused to engage said top member thereby electrically joining said bottom members and said top member together until said balance weight moves back into said equilibrium position.

2. The movement-sensitive switch according to claim 1 wherein said chamber has a spherical shape.

3. The movement-sensitive switch according to claim 1 wherein said top and bottom members each has a hemispherical shape.

4. The movement-sensitive switch according to claim 1 wherein said balance member has a hemispherical shape.

5. The movement-sensitive switch according to claim 1 wherein said top and bottom members each have outward extending flanges, and said insulation is disposed between said flanges so as to electrically insulate said top member from said bottom member.

6. A movement sensitive switch comprising top and bottom electrically conductive, hollow hemispherical members joined together along the circumference thereof so as to form a hollow, dry spherical chamber;

insulation disposed between said top and bottom hemispherical members to electrically insulate each of said members from each other; and an electrically conductive balance weight having a hemispherical bottom section integral with a generally flat top section, said top section fixed to an upwardly extending electrically conductive pin member, said balance weight and said pin member disposed in said spherical chamber such that (i) said spherical section of said balance weight is engaged with only the inner surface of said bottom hemispherical member, and said pin member extends upwardly into the hollow interior of said top hemispherical member a predetermined distance; and (ii) when said chamber is moved, said pin is caused to engage said top hemispherical member thereby electrically joining the bottom hemispherical member and said hemispherical member together until said balance weight moves back into said equilibrium position.

7. A movement-sensitive switch comprising electrically isolated electrically conductive top and bottom hollow spherical members coupled together forming a discrete hollow dry chamber; and a selective contact means for electrically coupling said top and bottom members together, said contact means having a free floating pendulum configuration and disposed in said chamber so as to engage said bottom member in a stable, equilibrium position such that (i) moving said chamber causes said contact means to electrically couple said bottom member with said top member; and (ii) said contact means configured to automatically return to said stable position with said bottom member again electrically isolated from said top member when movement of said chamber ceases.

8. The movement-sensitive switch according to claim 7 wherein said top and bottom members, joined together, have a spherical configuration.

9. The movement-sensitive switch according to claim 7 wherein said contact means has a generally hemispherical bottom section joined to an upwardly extending pin.

* * * * *

UNITED STATES PATENT AND TRADEMARK OFFICE

CERTIFICATE OF CORRECTION

PATENT NO. : 4,039,789

DATED : August 2, 1977

INVENTOR(S) : TAKESHI HASE

It is certified that error appears in the above-identified patent and that said Letters Patent are hereby corrected as shown below:

In the Title:

After "[22] Filed: September 8, 1975, insert,

--[30] February 17, 1975 Japan...50/22409--.

Signed and Sealed this

*First* Day of *November 1977*

[SEAL]

*Attest:*

RUTH C. MASON
*Attesting Officer*

LUTRELLE F. PARKER
*Acting Commissioner of Patents and Trademarks*